United States Patent [19]

Leibrock

[11] 4,111,664

[45] * Sep. 5, 1978

[54] METHOD OF AND AN ARRANGEMENT FOR MAKING STABLE MASSIVE COMPACTED COAL CHARGE BODIES FOR USE IN A COKING OVEN

[75] Inventor: Kurt Leibrock, Fürstenhausen, Fed. Rep. of Germany

[73] Assignee: Saarbergwerke Aktiengesellschaft, Saarbrucken, Fed. Rep. of Germany

[ * ] Notice: The portion of the term of this patent subsequent to Aug. 22, 1995, has been disclaimed.

[21] Appl. No.: 810,798

[22] Filed: Jun. 28, 1977

[30] Foreign Application Priority Data

Jun. 29, 1976 [DE] Fed. Rep. of Germany ..... 2629122

[51] Int. Cl.[2] ..... C10L 5/00; B30B 11/00; B30B 15/14

[52] U.S. Cl. ..... 44/10 G; 44/11; 100/209

[58] Field of Search ..... 44/2, 11–13, 44/10 D, 10 E, 10 G; 75/42; 100/209, 218, 237

[56] References Cited

U.S. PATENT DOCUMENTS

| | | | |
|---|---|---|---|
| 692,605 | 2/1902 | Bratton | 100/209 |
| 1,498,318 | 6/1924 | Bulkeley | 100/237 |
| 2,275,398 | 3/1942 | Koppers | 100/218 |
| 3,655,316 | 4/1972 | Husges | 100/218 |
| 3,758,385 | 9/1973 | Fischer | 44/10 D |

FOREIGN PATENT DOCUMENTS

| | | | |
|---|---|---|---|
| 358,981 | 10/1931 | United Kingdom | 44/10 G |

*Primary Examiner*—Carl Dees
*Attorney, Agent, or Firm*—Michael J. Striker

[57] ABSTRACT

A massive compacted coal charge body is made by pounding a particulate bed consisting of moist coal particles by a plurality of sequentially operated rams until the particulate bed is converted into a charge body the height of which exceeds its width by at least eleven times and the charge body having a specific density of at least 1.1 metric tons/m$^3$. Each of the rams has a ram body and a ram rod extending upwardly from the ram body, the ram rod being engaged and clamped for joint lifting by one or a pair of lifting members. Each lifting member is pivotally mounted on a shaft and has an eccentric engaging surface which comes into engagement with the respective ram rod. When two lifting members are associated with each ram rod, both of them are pivoted in synchronism. In the upper position of the ram, each lifting member releases the respective ram rod to permit the respective ram to descend onto the particulate bed in a free gravitational fall. The individual rams are mounted on one or more carriages which are reciprocatable longitudinally of a mold in which the particulate bed is confined by such a distance that the entire exposed surface of the particulate bed is acted upon by the rams. The movement of the carriages and that of the rams are independent of one another.

42 Claims, 8 Drawing Figures

METHOD OF AND AN ARRANGEMENT FOR MAKING STABLE MASSIVE COMPACTED COAL CHARGE BODIES FOR USE IN A COKING OVEN

BACKGROUND OF THE INVENTION:

The present invention relates to a method of and an arrangement for compacting coal particles into stable bodies, and more particularly to such a method and arrangement which is capable of making massive charging bodies to be used in charging a coking oven.

It has already been proposed to compact coking coal outside of the coking chamber in a box-shaped compacting mold by resorting to the use of rams which are supported on a ramming frame and each of which has a ram rod and a ram body which is attached to one end of the ram rod.

Experience has shown that, when certain bituminous coals are used for charging the coking ovens of a coke-manufacturing installation, a satisfactory coke can only be obtained when the coal charge is compacted. This is particularly true for highly volatile coals. When compacting is resorted to, the coking coal to be coked is compacted, layer-by-layer, to a charge body in a box-shaped compacting mold situated outside of the coking oven chamber, by means of rams. Such coking coal may be moisturized with water prior to the compacting thereof to improve the consistency and stability of the charge body. The so-obtained compacted charge body is then pushed into the coking oven chamber to undergo the coking process therein.

A reliable and unproblematical introduction of the charge body into the coking oven chamber presupposes that the ready-to-use charge body possesses a sufficient stability. More particularly, the stability of the charge body must be such that disintegration of the charge body even into a small number of parts is avoided during the introduction of the charge body into the coking oven chamber.

The stability of the final charge body can be improved, on the other hand, by increasing the moisturization of the particulate bed which is to be converted into the charge body. On the other hand, the stability of the charge body also improves with an increase in the degree of compaction and thus in the specific density of the final charge body. Besides the improved stability, an increased specific density of the material of the charge body favorably reflects in the properties of the coke produced by resorting to the above-mentioned compaction, especially in the tendency of the coke to develop cracks and the strength of its structure.

However, the stability of the charge body also additionally depends on the proportion of the width of the charge body to its height. There exists a widespread opinion that the charge body possesses a sufficiently high stability only when the ratio of its width to its height does not exceed 1:9. This means, assuming that the coking oven has a standard width of 0.45 m, as is very often the case, that the height of the charge body must not exceed approximately 3.7 m. As a result of this, the coking ovens currently employed in coking installations operating according to the above-mentioned principles have heights not exceeding 4 m. As a result of the fact that the ratio of the width of the charge body to its height presently amounts to at most 1:9, the coking oven throughput, that is, the throughput of coal related to a unit of useful space of the coking oven as well as to a time unit, is relatively small.

SUMMARY OF THE INVENTION

Accordingly, it is a general object of the present invention to provide the above-mentioned disadvantages.

More particularly, it is an object of the present invention to devise a method of making charge bodies for use in coking installations which is not possessed of the above-enumerated disadvantages of the prior-art methods.

It is still another object of the present invention to provide a method of making massive charge bodies for coking ovens, which increases the throughput of a coking oven.

Yet another object of the present invention is to develop a method of the above-mentioned kind which results in the production of coke of an improved quality as compared to those produced according to the prior-art methods.

A concomitant object of the present invention is to construct an apparatus for performing the above-mentioned method which is simple in construction, reliable in operation, and inexpensive to manufacture.

In pursuance of these objects and others which will become apparent hereafter, one feature of the present invention resides, briefly stated, in a method of making stable massive compacted coal charge bodies to be charged into a coking oven, which comprises the steps of supplying coal particles into a confining space to form a particulate bed therein; and subjecting the particulate bed to compacting forces requisite for converting the particulate bed into a respective charge body of a substantially parallelepiped configuration the height of which amounts to at least eleven times it width and having a specific density of at least 1.1 metric tons/m$^3$. Advantageously, the method of the present invention also comprises the step of bringing the particulate bed to a water content of at most approximately 12%.

The method according to the present invention assures a large throughput of the coking oven primarily as a result of the fact that the height of the parallelepiped charge body is at least eleven times greater than the width thereof. However, the large throughput of the coking oven also results from the fact that the specific density of the compacted charge in the charge body is greater than 1.1 metric tons per cubic meter. More particularly, when the coking coal is compacted to such a great extent, the heat transmission within the charge body is particularly great during the coking operation, which renders it possible to coke the charge for a shorter period of time.

However, on the other hand, the relatively great specific density has another advantageous affect in that the properties of the coke obtained from such compacting coking charge are improved. Among such improved properties, a comparatively higher wear resistance and a relatively higher strength of the so-obtain coke are worthy of mentioning. In addition thereto, such a high degree of compaction assures the requisite stability of the final charge body, especially when the coking coal is moisturized before the compaction thereof to a water content of up to approximately 12%.

It is currently recommended to bring the coking coal to a water content of approximately 7 to 8%. When the specific density is greater than 1.1 metric tons/m$^3$, as is proposed by the present invention, this water content is sufficient for achieving a sufficient stability of the final charge body.

It is further advantageous, as proposed by the present invention, to compact the coking coal during the making of the charge body to a specific density of approximately 1.2 metric tons/$m^3$. As a result of this, the throughput capacity of the coking oven and also the properties of the coke produced therein are further improved. Advantageous results are obtained when the height of the charge body at the end of the compacting operation is approximately 14 to 16 times, preferably 15 times, greater than its width. According to a further currently preferred concept of the present invention, the parallelepiped charge body has, at the end of the compacting operation, a height of at least 5.6 m related to a length of, for instance, 16 m, which renders it possible to utilize large-volume coking ovens having a capacity of, for instance, 40 $m^3$.

A density which is very high and substantially uniform throughout the entire volume of the compacting mold can be achieved in a simple manner and in a relatively short time when the rams are supported on at least one carriage which is displaced in the longitudinal direction of the compacting mold in a reciprocatory manner. Then, each ram is pressed against the particulate coking coal of the particulate bed while the carriage simultaneously reciprocates and while coking coal is being supplied into the compacting mold to the respective rams, and then lifted from the particulate bed in a repeated time sequence. Preferably, at least each two adjacent rams of the respective carriage are pressed against and lifted from the particulate bed of coking coal after one another.

This operation of the rams has the advantage that the gas which is driven out of the particulate bed during the compacting of the coking coal, particularly air, can easily escape into the ambient atmosphere and the coal can be supplied into the compacting mold, substantially without inference, simultaneously with the compacting operation. This results from the fact that the exposed surface region of the particulate bed constituted by the coal supplied into the compacting mold, which is acted upon by the rams, is covered, at any particular instant of time, only by one ram or a small number of the rams. Also, in this manner, it is of a particular advantage that those rams which adjoin that ram which is in contact with the particulate bed are lifted from the particulate bed during the contact of the ram which is located between such adjacent rams with the exposed surface of the particulate bed.

It is further proposed, according to an advantageous and currently preferred facet of the present invention, to achieve the pressing of the respective ram against the exposed surface of the particulate bed of coking coal by releasing the respective ram for a free fall toward the particulate bed. As a result of this, it is merely necessary to supply energy to the respective ram during the lifting thereof from the particulate bed. This has a further advantage, in connection with the above-described lifting and lowering succession of the movement of the rams, that energy is to be supplied only to one or only to a small number of rams at any particular instant of time in order to lift the same.

The specific density can be further increased and improved in the sense of a greater uniformity in that each ram of the respective carriage is moved, during the reciprocation of the carriage, at least by a distance measured in a respective direction of reciprocation and amounting to a sum of a dimension of a respective ram, a spacing of the respective ram from an adjacent ram, and a spacing of such adjacent ram from a next-adjacent ram, all taken in the direction of reciprocation. When this measure is resorted to, the specific density is high and, additionally, also uniform in all regions of the final charge body, even when any individual ram fails to perform its task as a result of a breakdown, in that the task of the non-operative ram is performed by the ram adjoining such a non-operative ram.

In order to be able to transmit the compacting energy uniformly into the particulate bed of coking coal supplied into the compacting mold, it is recommended that the rams act on the coking coal over the entire length of the compacting mold during the reciprocation of the carriage or the plurality of such carriages.

It is currently preferred to drive the ram-supporting carriages by at least one hydraulically energized cylinder-and-piston unit. When such a hydraulic cylinder-and-piston unit is used, the movement of the ram-supporting carriages is performed at a low level of attendant noise. However, it is also possible to use at least one advancing endless chain for the driving of the ram-supporting carriages.

It is also preferred, according to a further aspect of the present invention, to interconnect the ram-supporting carriages to a reciprocating carriage unit, and to reciprocate such a carriage unit in unison by a single drive. While it is true that the above-discussed expedients of the present invention can also be utilized in a compacting arrangement of conventional construction in which a plurality of individually moving and individually driven ram-supporting carriages is used and/or wherein the change of direction of movement of the carriages is achievable, for instance, by utilizing mutual abutment of the carriages against one another as well as abutment of the terminal carriage or of a single carriage against abutments arranged at the ends of the compacting mold, such expedients are especially advantageous when the ram-supporting carriages are connected to one another and driven in unison.

It is further advantageous to supply energy to each ram for moving the same independently from the drive for the ram-supporting carriage which supports such a ram. As a result of the independence of the drive for the rams and for the carriages, it is achieved that the compacting operation need not be interrupted in the event that one of the rams becomes inoperative.

An achievably high and simultaneously uniform compacting density throughout the entire volume of the compacting mold requires a large number of lifting and lowering movements of the rams per time unit. Also, when the rams are pressed against the exposed surface of the particulate bed present in the compacting mold as a result of the free fall of such rams due to gravitational forces, it is further necessary to assure that the rams will be lifted from the particulate bed to the requisite and substantial extent which remains the same for all of the lifting operations of the rams. Namely, a low lifting distance means a small free-fall distance covered by the ram which, in turn, results in only an insufficient specific density of the final charge body. The method of the present invention presupposes especially large lifting distances inasmuch as the height of the final charge body is at least eleven times greater than its width.

When the compaction is achieved by free-falling rams, it is recommended to so construct the device for lifting the rams, which is capable of performing the method of the present invention, that at least one lifting member is associated with each of the rams, such a lifting member being movable in the direction of movement of the ram, that is, upwardly and downwardly. This lifting member then clampingly engages the respective ram at the beginning of its upward movement and releases the ram, by discontinuing its clamping action, in the upper position of the respective ram. The lifting member is driven at least during its upward movement.

An arrangement constructed in this manner is of a particularly simple construction. In this arrangement, the lifting means can simultaneously be used for holding the respective ram in its upper position after the termination of the compacting operation and during the following introduction of the final charge body into the coking chamber of the coking oven. More particularly, the holding of a ram in its upper position between two following compacting operations can be achieved, in a very simple manner, in that the ram remains clamped in its lifted position for a holding period of time and is released only at the expiration of such a holding period.

The arrangement of the present invention is further characterized by a very low noise generation and by a very low wear of its component parts as well as of the rams. Finally, a constant and, furthermore, large lifting distance can be achieved with such an arrangement during the sequential upward movements of the rams.

It is further recommended that each lifting member be mounted on a horizontal shaft for pivoting into a clamping contact with the associated ram. It is further advantageous to provide, for each ram, two lifting members which are arranged at opposite sides of the respective ram at the same elevation. Preferably, such lifting members are mounted on a common, circumferentially complete carrier frame. As a result of the use of two lifting members for each ram, the clamping effect is significantly increased. Furthermore, it is advantageous when each of the ram rods of the respective rams has a double-T-shaped configuration and each lifting member comes into contact with the bight of the associated ram rod.

According to a currently preferred embodiment of the present invention, the contact surface of each lifting member extends eccentrically with respect to the pivoting axis of the associated shaft. In this connection, it is sufficient for the contact surface of the lifting member to extend over an angle of less than 90° about such pivot axis.

In order to achieve a secure lifting of the rams, it is recommended to simultaneously engage the two lifting members associated with a particular ram with the ram rod thereof, and to also simultaneously disengage such lifting members from this ram rod. According to a further advantageous concept of the present invention, this is achieved in that each of the lifting members of a respective ram is connected with a gear segment for joint pivoting, preferably by being mounted on a common shaft therewith. The two shafts may then be mounted in a common horizontal plane and the teeth of one of the gear segments will mesh with the teeth of the other segment.

The contacting of a lifting member with the associated ram in the lower position thereof and the disengagement of such lifting member from such ram in the lifted position of the ram can be achieved by a pivoting drive which acts on the shaft associated with the lifting member. However, the contacting and disengaging does not necessarily presuppose a positive drive. So, for instance, the contacting can be achieved automatically, in that the lifting member is freely pivotably mounted on its associated shafts and moves into its engaging position solely under the influence of its own weight. Under these circumstances, the disengagement of the lifting member from the ram in the lifted position of the latter, and thus the release of the ram for free gravity fall, can be achieved in a reliable manner solely as a result of the fact that a pivoting arm is connected to the shaft of the lifting member for joint pivoting therewith, such pivoting arm being pivotable in a vertical plane, thus rotating the shaft; the pivoting arm cooperates with a stationary abutment of the arrangement in the upper position of the associated ram in such a manner that the pivoting arm rotates the shaft and thus the lifting member into its disengaging position in which it releases the ram.

In order to minimize or even eliminate wear of the ram and of the lifting member which would otherwise occur due to sliding friction between the two, it is further proposed according to the present invention to provide each ram rod with a frictional coating in the region thereof acted upon by the respective lifting member. The lifting device of the arrangement of the present invention is preferably so constructed that it includes at least one cylinder-and-piston unit, the piston rod of which extends in the direction of movement of the associated ram, the free end of the piston rod being coupled to the above-discussed lifting member or lifting members. In this connection, it is advantageous when each cylinder-and-piston unit is coupled to the respective carriage at its upper region, so that the piston rod points toward the compacting mold with its free end in the operative condition. A more uniform guidance of each ram rod during the lifting of the respective ram can be achieved when the lifting device includes a pair of the above-mentioned cylinder-and-piston units, each of such units being arranged at one side of the respective ram rod of the associated ram, the piston rod of such units being uniformly movable. It is further preferred when each of such cylinder-and-piston units includes a hydraulically operated cylinder.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
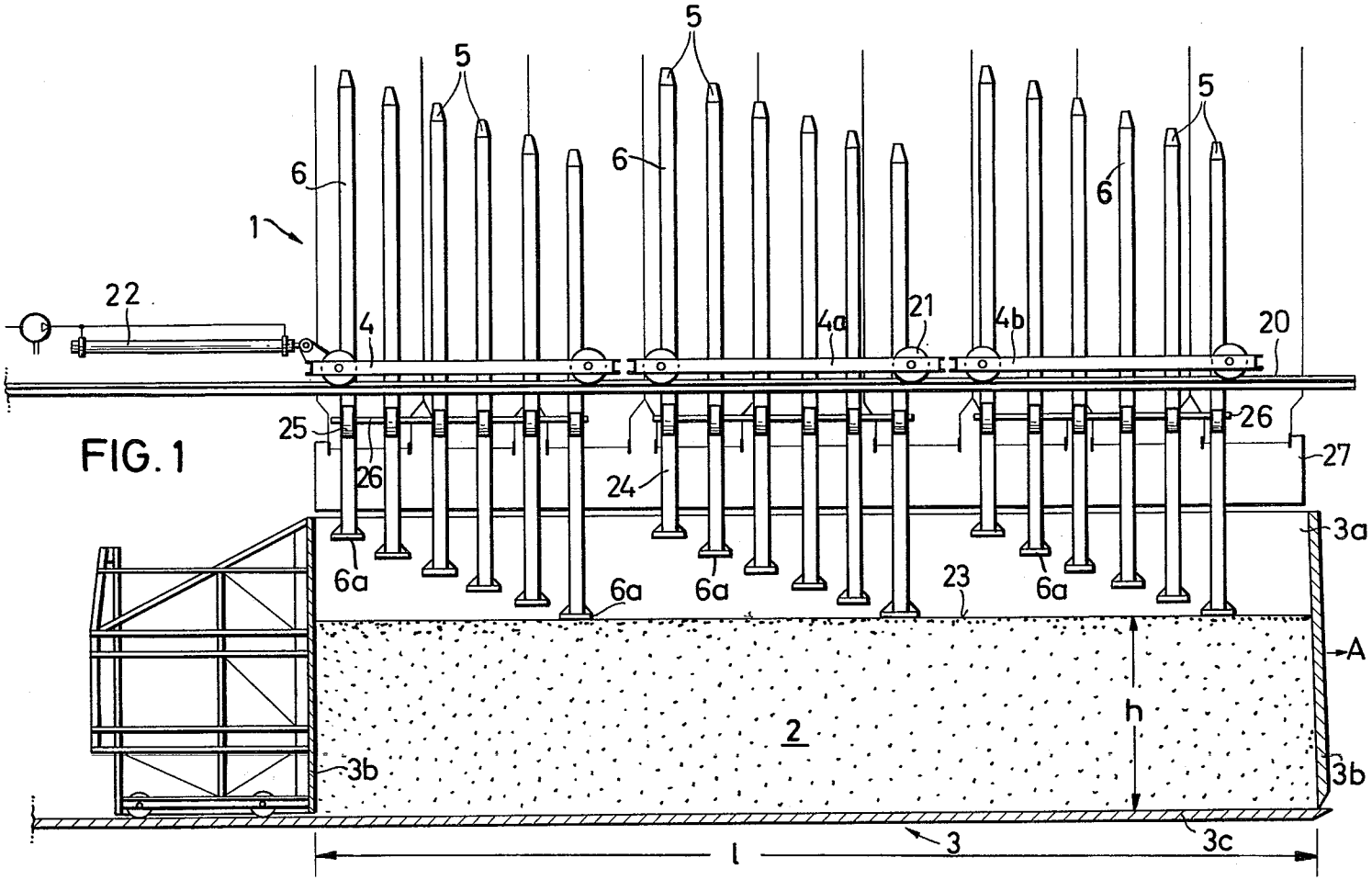
FIG. 1 is a side elevational view, partially sectioned, of a compacting arrangement of the present invention.

Referring now to the drawing in detail, and first to FIG. 1 thereof, it may be seen therein that the reference numeral 1 has been used to designate a compacting arrangement for use in a coking installation in toto. The compacting arrangement 1 is arranged above a compacting mold 3 which, as illustrated, is almost entirely filled with a bed 2 of particulate coking coal. The compacting arrangement 1 is mounted on a support which is not illustrated in detail.

The compacting mold 3 is substantially of a parallelepiped configuration and includes two vertical lateral walls 3*a*, two end walls 3*b*, and a bottom plate 3*c*.

Figure 3:
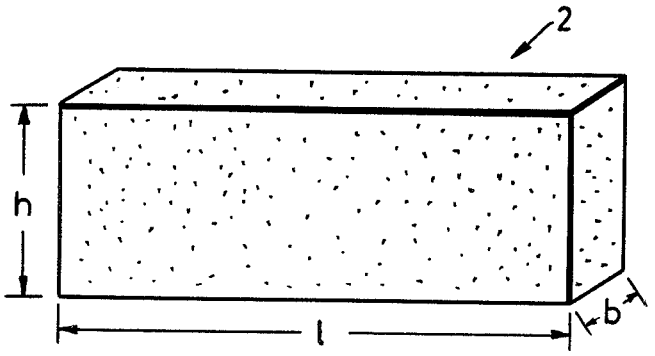
FIG. 3 is a perspective view of a final charge body obtained according to the method of the present invention.

As illustrated in FIG. 3, the finished charge body made in the compacting mold 3 has a length *l*, and width *b* and a height *h*. The height *h* of the final compacting charge body 2 is fifteen times greater than the width *b* thereof. In practice, the height *h* of the charge body will amount to 5.7 m. The coking coal of the particulate bed 2 has a water content of 7.5%, and is compacted to a specific density of 1.2 metric tons/$m^3$ to obtain the charge body 2.

As seen in FIG. 1, the particulate bed 2 rests on the bottom plate 3*c* of the compacting mold 3 and is confined between the end walls 3*b* and the stationary side walls 3*a*. The end walls 3*b* are movable so that, when the particulate coal is compacted to the requisite density to obtain the charge body 1, the latter can be moved in the direction of the arrow A into a non-illustrated coking chamber of a coking oven.

Figure 4:
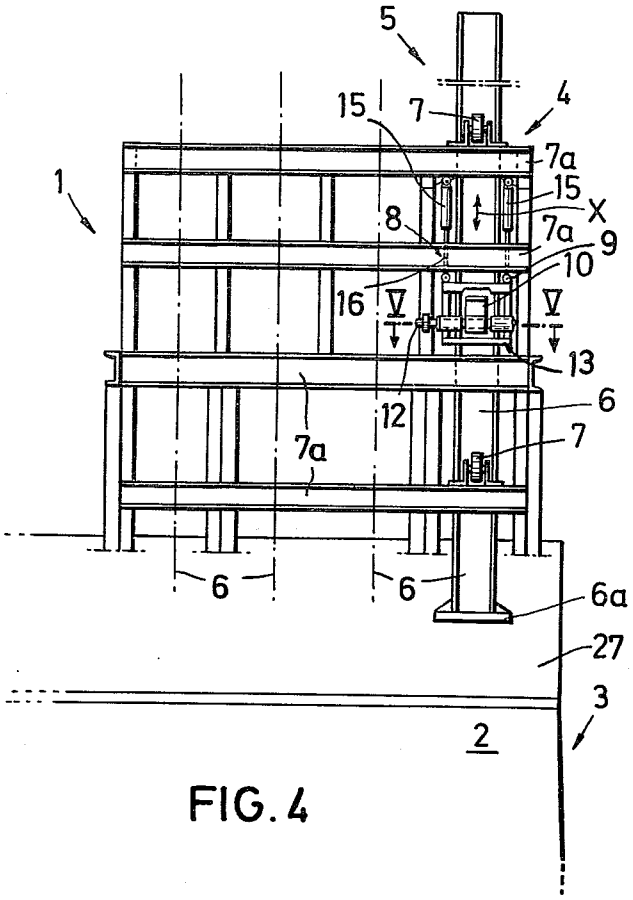
FIG. 4 is a view similar to FIG. 1 but of a modified compacting arrangement.

The compacting arrangement 1 includes three carriages 4, 4*a* and 4*b* which are interconnected with one another into a carriage unit. Only one of the carriages, that is, carriage 4, is illustrated in FIG. 4.

Figure 2:
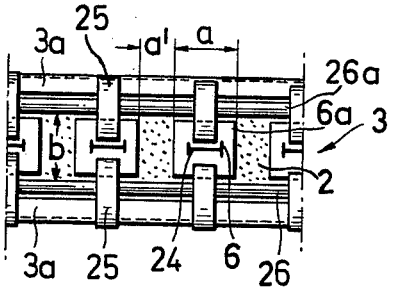
FIG. 2 is a horizontally sectioned view of a part of a carriage used in the arrangement of FIG. 1.

As illustrated in FIGS. 1 and 2, six geometrically identical rams 5 are mounted on each of the carriages 4, 4*a* and 4*b* while four of such rams 5 are supported on the respective carriage 4 in the modification illustrated in FIGS. 4–8. Each of the rams 5 has a ram rod 6 constituted by double-T-shaped beams, and a ram body 6*a* connected to the ram rod 6. The rams 5 are mounted on the respective carriage 4, 4*a* or 4*b* for lifting and lowering and at a mutual distance *a'* between the ram bodies 6*a*, as indicated in FIG. 2.

As also illustrated in FIG. 1, the carriages 4, 4*a* and 4*b* are mounted on a pair of rails 20 by means of rollers 21 for reciprocation in the longitudinal direction of the compacting mold 3 by means of a hydraulically energized cylinder-and-piston unit 22. The reciprocating distance of the carriages 4, 4*a* and 4*b* is so selected that each of the carriages 4, 4*a* and 4*b* reciprocates, during each reciprocatory cycle, by a distance which corresponds to a width *a* (see FIG. 2) of a ram body 6*a* as measured in the longitudinal direction of the compacting mold 3, and twice the distance *a'* between two adjacent ram bodies 6*a* of the respective carriage 4, 4*a* or 4*b*, also measured in the longitudinal direction of the compacting mold 3. On the other hand, the reciprocating distance is so selected with respect to the compacting mold 3 that the ram bodies 6*a* of all three of the carriages 4, 4*a* and 4*b* act on the exposed surface 23 of the particulate bed 2 over the entire length of the compacting mold 3 during the reciprocation of the carriages 4, 4*a* and 4*b*.

The ram body 6*a* of the rams 5 of each of the carriages 4, 4*a* and 4*b*, for the purpose of compacting and densifying the coking coal, are pressed in a free gravity fall against and lifted from the exposed surface 23 while the unit 4, 4*a* and 4*b* reciprocates, in such a manner that, at any given instant, only one of the rams 5 of the respective one of the carriages 4, 4*a* and 4*b* is in contact with the coking coal, as illustrated in FIG. 1. A device for lifting each of the rams 5 is incorporated in the respective compacting arrangement 1.

As illustrated in FIGS. 1 and 2, each of the rams 5 is lifted by means of rotating lifting disks 25 which are arranged at two sides of the ram rod 6 of the respective ram 5, which are in engagement with a bight 24 of the respective ram rod 6, and which are eccentrically mounted at the same elevation for yielding relative to the ram 5. In this arrangement, the lifting disks 25 which are arranged at the same side of the respective carriage 4, 4*a* or 4*b* and which engage its rams 5, are offset with respect to one another by 60°, being connected to a common shaft 26 or 26*a*. The shafts 26, 26*a* of the respective carriages 4, 4*a* or 4*b*, are acted upon by an electromotor in such a manner that the lifting and lowering movement of the rams 5 is conducted independently from the reciprocation of the carriages 4, 4*a* and 4*b*.

Referring now to FIGS. 4–8 and to the arrangement illustrated therein, it may be seen that each of the rams 5 has its own lifting arrangement 8. In order not to unduly encumber the drawing, only a single ram 5 with its associated lifting arrangement 8 is illustrated in FIG. 4. Each of the rams 5 is guided by guiding rollers 7 and carriers 7*a*.

The lifting arrangement 8 of this modification includes two lifting members 10 that are movable in the upward and downward directions in and opposite to the direction X, being mounted for such a movement in a frame 9. The two lifting members 10 are respectively arranged at opposite sides of the ram rod 6, at the same elevation. Each of the lifting members 10 is mounted on its associated shaft 12, together with a respective toothed segment 11. The two shafts 12 are parallel to one another and located in a common horizontal plane. The teeth of the two toothed segments 11 mesh with one another. As a result of this, the two lifting members 10 associated with the respective ram 5 are simultaneously movable into their engaging position in which they clamp the respective ram rod 6 between themselves and, also simultaneously, toward their disengaging position in which they release the ram 5.

Figure 5:
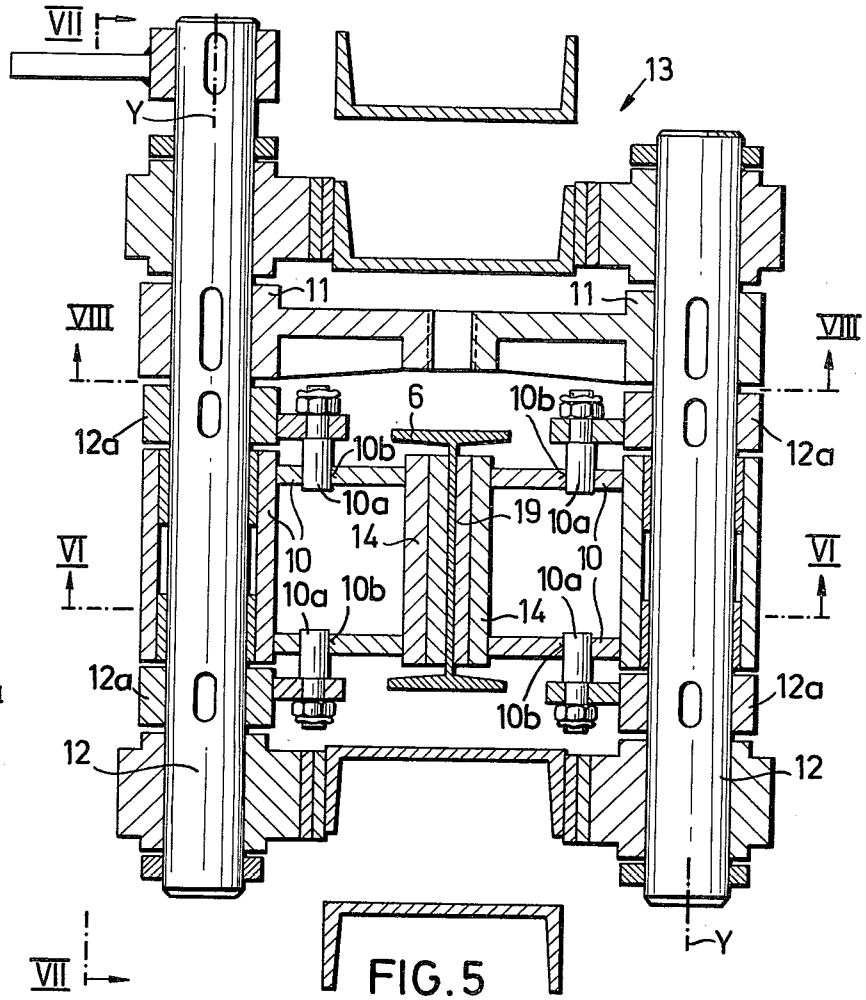
FIG. 5 is a partial sectional view taken on line V—V of FIG. 4.
Figure 7:
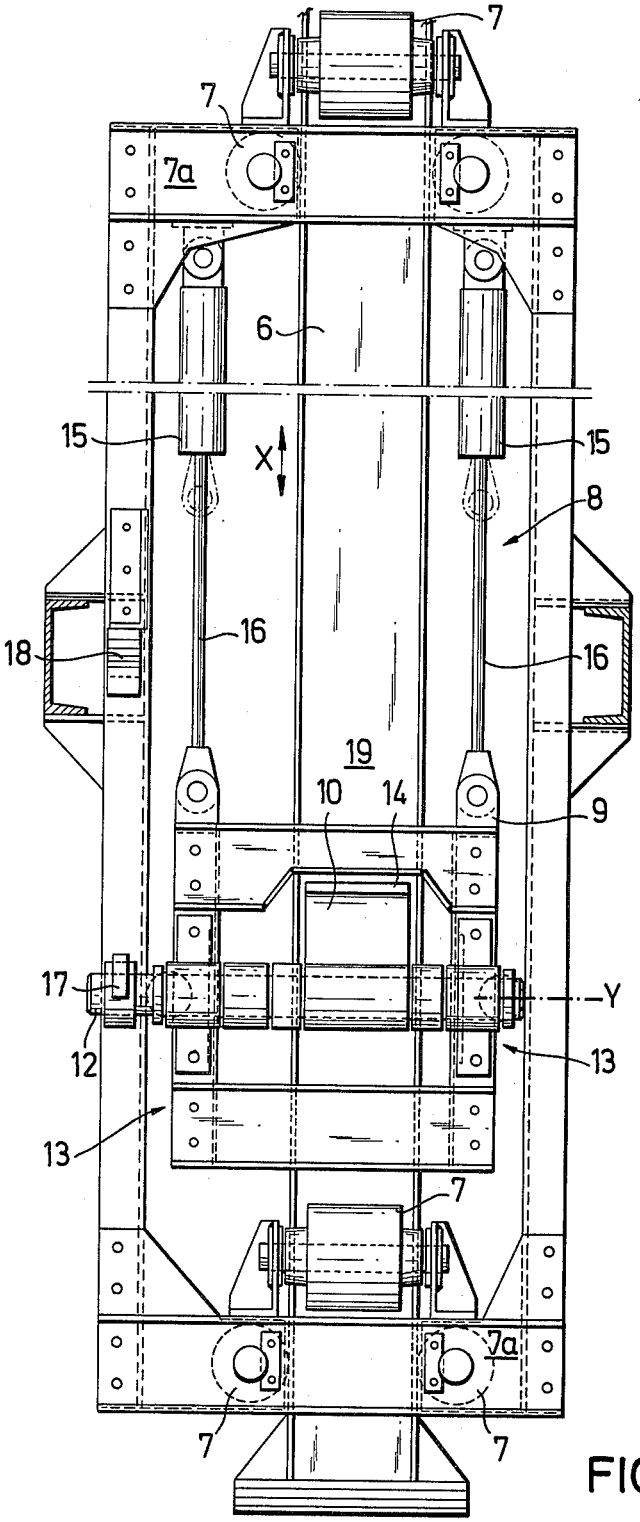
FIG. 7 is a partial sectional view taken on line VII—VII of FIG. 5.

As will be ascertained from a reference to FIGS. 5 and 7, the lifting members 10, together with their associated shafts 12 are mounted in a common, circumferentially complete, carrying frame 13. The lifting members 10 have contact surfaces 14 which come into contact with the bight 24 of the ram rod 6. To minimize the wear of the lifting members 10 and of the ram rods 6, the respective bight 24 of the respective ram rod 6 is provided with a frictional coat 19 in the region in which the two lifting members 10 come into contact with the ram rod 6.

Figure 6:
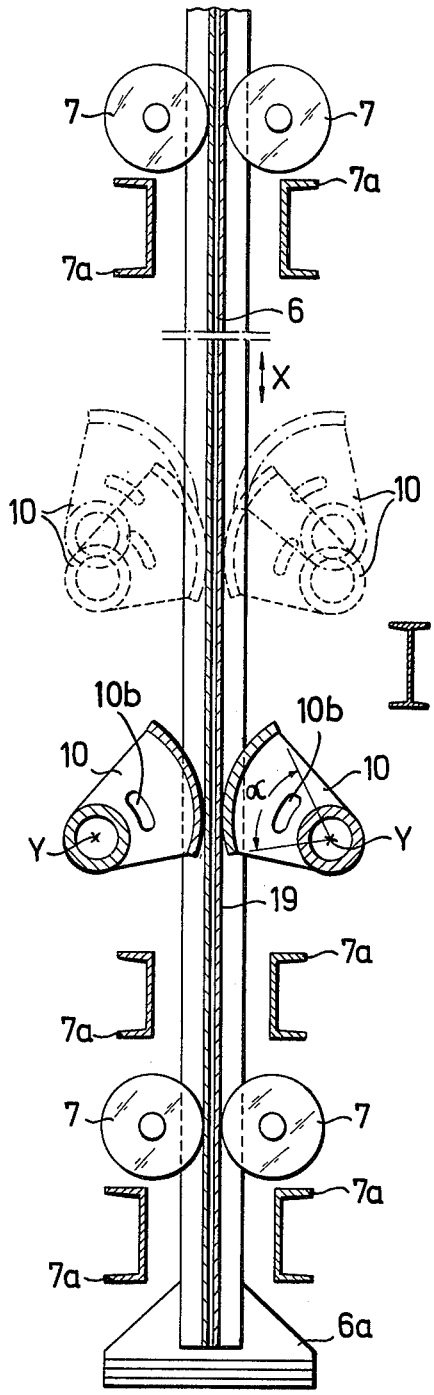
FIG. 6 is a partial sectional view taken on line VI—VI of FIG. 5.

Each of the lifting members 10 is mounted on the associated shaft 12 with freedom of pivoting movement, as particularly seen in FIG. 5. The pivoting movement of the lifting members 10 is limited by bolts 10*a*, which are detachably connected to annular catches 12*a* being attached to the shaft 12 and engaging slots 10*b* in the lifting members 10. This Figure, in connection with FIG. 6, also illustrates in detail how the lifting members 10 are constructed. More particularly, it may be seen that the contact surface 14 of each lifting member 10 extends eccentrically with respect to a pivot axis Y of the respective lifting member 10. The contact surface 14 of each lifting member 10 extends through an angle of approximately 60° about the pivot axis Y. This angle is indicated in FIG. 6 as alpha. Inasmuch as the center of gravity of each of the lifting members 10 is offset from the respective pivot axis Y, and since the respective center of gravity of the respective lifting member 10 is located closer to the respective ram rod 6 than the pivot axis Y, it is achieved that the influence of gravitational forces on the respective lifting member 10 will cause the latter to pivot toward its engaging position in which the bight 24 of the respective ram rod 6 is clamped between the contact surfaces 14 of the two lifting members 10.

FIG. 7 illustrates in detail how the lifting device 9 is constructed. The lifting device 9 is provided, at each outer side of the transverse webs of the ram rod 6, with a cylinder-and-piston unit having a hydraulic cylinder 15. Each of the two cylinders 15 is coupled to an upper steel carrier 7*a* of the compacting arrangement 1, which carrier 7*a* also simultaneously serves as a support. Herein, a piston rod 16 of each cylinder 15 extends in the direction X of movement of the ram 5 towards the compacting mold 3. The carrying frame 13 for the lifting member 10 is connected to the respective free ends of the two piston rods 16.

During a compacting operation, the two piston rods 16 of the two cylinders 15 are continuously extended and retracted in a cyclical manner and concurrently with one another. As a result of this, the lifting members 10 are cyclically lifted and again lowered due to their mounting, via the carrier frame 13, on the piston rods 16 of the lifting arrangement 9.

As a result of the fact that the lifting members 10 come into clamping contact with the ram rod 6 of the respective ram 5 alone by the influence of their own weight, the ram 5 is clampingly engaged by the lifting members 10 in the lowermost position thereof at the commencement of the upward movement of the lifting members 10. As a result of this, the respective ram 5 is being lifted while the piston rods 16 are being retracted into the respective cylinders 15. When the lifting members 10 reach their uppermost position, the respective ram 5 is always automatically released. For this purpose, there is connected to the shaft 12 of at least one of the two lifting members 10 a pivoting arm 17 for joint rotation therewith. The pivoting arm 17 is pivotable in a vertical plane downwardly in the direction of the arrow Z, with simultaneous pivoting of the shaft 12. Such pivoting is achieved in that, as the ram 5 approaches its uppermost position, the pivoting arm 17 abuts against a stationary abutment 18 of the compacting arrangement 1 and, as a result of this, the pivoting arm 17 and thus the shaft 12 carrying the same and jointly therewith also the other shaft 12 of this lifting arrangement 8 and through the catches 12*a* and bolts 10*a* the two lifting members 10 pivot and release the ram rod 6 of the ram 5. As a result of such a release, the ram 5 can then move downwardly in a free gravitational fall until it reaches its lowermost position.

Figure 8:
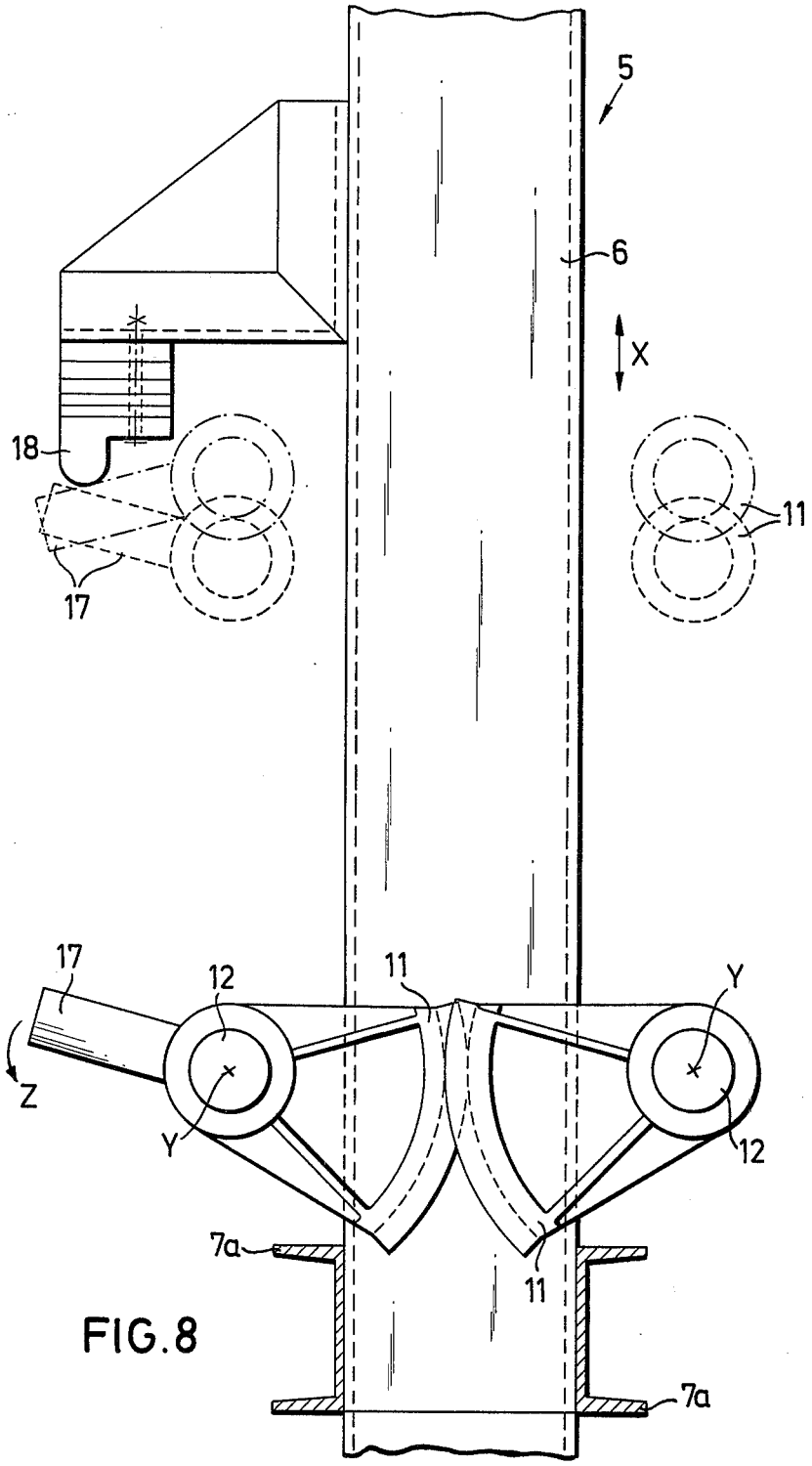
FIG. 8 is a partial sectional view taken on line VIII—VIII of FIG. 5.

In FIGS. 6 and 8, the lifting members 10 and their associated toothed segments 11 are illustrated not only in their lowermost positions in full lines, but also in their lifted positions, in dashed and dash-dotted lines. The illustrated lifted position is that assumed shortly before or shortly after the release of the ram 5. Upon the release of the ram 5, and particularly upon its reaching its lowermost position, the piston rods 16 of the two cylinders 15 are again extended until the lifting members 10 reach their lowermost positions, whereupon the whole cycle can be repeated.

Upon the termination of the compacting operation, that is, upon the conversion of the particulate bed into the compacted charge body 2, the ram 5 is retained in its lifted position by means of the lifting members 10. To achieve this, the lifting members 10 remain in clamping contact with the ram rod 6 during this holding time. More particularly, the release of the ram 5 after the termination of the compacting operation is avoided in that the piston rods 16 of the cylinders 15 are not fully retracted so that the pivoting arm 17 cannot be pivoted as a result of its cooperation with the stationary abutment 18.

The coking coal is continuously supplied in a uniform manner into the compacting mold 3 during the compacting operation via a slide 27. The coking coal is supplied to the slide 27 from a non-illustrated conventional coal storage hopper.

It will be understood that each of the elements described above, or two or more together, may also find a useful application in other types of constructions differing from the types described above.

While the invention has been illustrated and described as embodied in a compacting coking coal prior to introduction into a coking chamber, it is not intended to be limited to the details shown, since various modifications and structural changes may be made without departing in any way from the spirit of the present invention.

Without further analysis, for foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of making stable massive compacted coal charge bodies to be charged into a coking oven, comprising the steps of supplying coal particles into a confining space to form therein a particulate bed having an upper surface; and subjecting the particulate bed to compacting forces requisite for converting the particulate bed into a respective charge body of a substantially parallelepiped configuration the height of which amounts to at least 11 times its width and having a specific density of at least 1.1 metric tons/m$^3$, including contacting a plurality of rams with the upper surface of the particulate bed in such a time sequence that at least one of the rams is out of contact with the upper surface of the particulate bed at any instant.

2. A method as defined in claim 1; and further comprising the step of bringing the particulate bed to a water content of at most approximately 12%.

3. A method as defined in claim 2, wherein said bringing step includes limiting the water content of the particulate bed to between 7 to 8% prior to said subjecting step.

4. A method as defined in claim 1, wherein said subjecting step includes compacting the respective charge body to a specific density of approximately 1.2 metric tons/m$^3$.

5. A method as defined in claim 1, wherein said subjecting step includes so shaping the respective charge body at the height thereof amounts to between 14 and 16 times the width thereof upon the termination of said subjecting step.

6. A method as defined in claim 1, wherein said subjecting step includes so shaping the respective charge body at the height thereof amounts to at least 5.6 m related to a length of the respective charge body amounting to 16 m, upon the termination of said subjecting step.

7. A method as defined in claim 1, wherein said subjecting step includes mounting the rams on at least one carriage; displacing the carriage longitudinally of said confining space; and sequentially operating the rams to lower the same toward and lift the same from the particulate bed.

8. A method as defined in claim 7, wherein said supplying step includes introducing particulate coal into said confining space during said sequentially operating step.

9. A method as defined in claim 7, wherein said subjecting step includes simultaneously performing said displacing and sequentially operating steps.

10. A method as defined in claim 7, wherein said sequentially operating step includes lifting and lowering at least the adjacent ones of the arms in said time sequence.

11. A method as defined in claim 10, wherein said lowering step includes releasing the respective lifted ram for free gravity fall.

12. A method as defined in claim 7, wherein said displacing step includes reciprocating the carriage at least by a distance measured in a respective direction of reciprocation and amounting to a sum of a dimension of a respective ram, a spacing of the respective ram from an adjacent ram, and a spacing of such adjacent ram from a next adjacent ram, all taken in said direction of reciprocation.

13. A method as defined in claim 7, wherein said subjecting step includes exposing the particulate bed to said sequentially operating step over the entire length of the bed during said displacing step.

14. A method as defined in claim 7, wherein said displacing step includes acting on the carriage by at least one cylinder-and-piston unit.

15. A method as defined in claim 7, wherein said mounting step includes mounting the rams on a plurality of carriages; and wherein said displacing step includes connecting the carriages to a unit to simultaneously displace the carriages of the unit.

16. A method as defined in claim 7, wherein said subjecting step includes performing said displacing and sequentially operating steps independently from one another.

17. An arrangement for making stable massive compacted coal charge bodies to be charged into a coking oven, comprising a mold bounding a confining space; means for introducing coal particles into said confining space to form therein a particulate bed having an upper surface; and means for subjecting the particulate bed to compacting forces requisite for converting the particulate bed into the respective charge body of a substantially parallepiped configuration the height of which amounts to at least 11 times its width and having a specific density of at least 1.1 metric tons, including a plurality of rams each of which is movable into and out of contact with the upper surface of the particulate bed, and means for so moving said rams in a time sequence that at least one of said rams is out of contact with the upper surface of the particulate bed at any instant.

18. An arrangement as defined in claim 17, wherein said subjecting means includes a plurality of rams.

19. An arrangement as defined in claim 17, wherein said mold is elongated; and wherein said subjecting means further includes at least one carriage; means for guiding said carriage for displacement longitudinally of said mold; and means for supporting said rams on said carriage for sequential lowering of the same toward and lifting of the same from the particulate bed.

20. An arrangement as defined in claim 19; and further comprising means for lifting said rams and for releasing the same for a free gravity fall onto the particulate bed.

21. An arrangement as defined in claim 20, wherein each respective ram has a ram body and a ram rod rigid with and extending upwardly from said ram body; and wherein said lifting means is operative for engaging said ram rod during the lifting of the respective ram.

22. An arrangement as defined in claim 21, wherein said lifting means includes at least one lifting member, means for mounting said lifting member on said carriage for sequential upward and downward movement relative thereto, and means for moving said lifting member at least in the upward direction.

23. An arrangement as defined in claim 22, wherein said lifting means further includes means for displaceably mounting said lifting member on said carriage for displacement between an engaging position in which it clamps said ram rod and a disengaging position in which it releases the latter.

24. An arrangement as defined in claim 23, wherein said displaceably mounting means includes a horizontally extending shaft on which said lifting member is mounted for pivoting.

25. An arrangement as defined in claim 24, wherein said shaft has a pivot axis; and wherein said lifting member has an engaging surface adapted to contact said ram rod and extending eccentrically with respect to said pivot axis.

26. An arrangement as defined in claim 25, wherein said engaging surface extends through an angle of at most 90° about said pivot axis.

27. An arrangement as defined in claim 25, wherein said lifting means further includes an additional lifting member similar to said lifting member; and wherein said mounting means mounts said additional mounting member across said ram rod from said lifting member and at the same elevation therewith.

28. An arrangement as defined in claim 27, wherein said mounting means includes a common frame for said lifting members.

29. An arrangement as defined in claim 27, wherein each of said ram rods is of a double-T configuration; and wherein each of said lifting members engages the bight of said ram rod from one side thereof.

30. An arrangement as defined in claim 27, wherein said displaceably mounting means mounts said lifting members for simultaneous engagement with and release from said ram rod.

31. An arrangement as defined in claim 27, wherein said displaceably mounting means includes means for simultaneously engaging said lifting members with and releasing the same from said ram rod.

32. An arrangement as defined in claim 31, wherein said simultaneously engaging and releasing means includes two engaging members each connected to one of said lifting members for joint pivoting therewith and in engagement with one another.

33. An arrangement as defined in claim 32, wherein each of said engaging members has a gear portion in meshing engagement with the gear portion of the other engaging member.

34. An arrangement as defined in claim 24, wherein said lifting member is mounted on said shaft for free pivoting under the influence of its own weight toward said engaging position thereof.

35. An arrangement as defined in claim 24, wherein said lifting means further includes means for pivoting said lifting member toward said disengaging position thereof when the respective ram is in its lifted position.

36. An arrangement as defined in claim 35, wherein said pivoting means includes a pivoting arm connected to said lifting member for joint pivoting therewith, and an abutment on said carriage within the path of joint upward movement of said pivoting arm with said lifting member and operative for pivoting said pivoting arm as said lifting means approaches the upward position thereof to thereby pivot said lifting member toward said disengaging position.

37. An arrangement as defined in claim 22, wherein said ram rod has a frictional coating in the region of engagement thereof with said lifting member.

38. An arrangement as defined in claim 22, wherein said moving means includes at least one cylinder-and-piston unit including a piston rod extending generally in the direction of movement of said lifting member and connected to the latter at its free end.

39. An arrangement as defined in claim 38, wherein said cylinder-and-piston unit further includes a cylinder which is connected to said carriage; and wherein said piston rod extends from said cylinder toward said mold in the operative position thereof.

40. An arrangement as defined in claim 38, wherein said lifting means includes an additional lifting member similar to said lifting member and mounted on said mounting means across said ram rod from said lifting member at the same elevation therewith; and wherein said moving means includes an additional cylinder-and-piston unit similar to said cylinder-and-piston unit and cooperating with said additional lifting member.

41. An arrangement as defined in claim 40, wherein said lifting means further includes means for synchronously energizing said cylinder-and-piston units.

42. An arrangement as defined in claim 38, wherein said cylinder-and-piston unit is a hydraulically energized unit.

* * * * *